US008281552B2

(12) United States Patent
Pilz et al.

(10) Patent No.: US 8,281,552 B2
(45) Date of Patent: Oct. 9, 2012

(54) EXTERIOR WALL CONSTRUCTION PRODUCT

(75) Inventors: Don A. Pilz, Livermore, CA (US); Raymond E. Poliquin, City of Industry, CA (US); Fernando Hernandez Sesma, City of Industry, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 579 days.

(21) Appl. No.: 12/039,685

(22) Filed: Feb. 28, 2008

(65) Prior Publication Data

US 2009/0178363 A1 Jul. 16, 2009

(51) Int. Cl.
*E04C 2/34* (2006.01)
*E04C 3/00* (2006.01)

(52) U.S. Cl. ..... 52/846; 52/481.1

(58) Field of Classification Search ..... 52/48.1, 52/483.1, 730.1, 730.6, 844, 846, 848, 241, 52/481.1, 489.1, 506.05, 710, 735, 737, 745.1, 52/831, 836
See application file for complete search history.

(56) References Cited

U.S. PATENT DOCUMENTS 1,130,722 A * 3/1915 Fletcher ..... 52/355
1,563,651 A * 12/1925 Pomerantz ..... 52/348
2,218,426 A 10/1940 Hulbert, Jr.
2,683,927 A 7/1954 Maronek
2,733,786 A 2/1956 Drake
3,129,792 A 4/1964 Gwynne
3,324,615 A 6/1967 Zinn
3,397,495 A 8/1968 Thompson
3,481,090 A 12/1969 Lizee
3,537,219 A 11/1970 Navarre
3,566,559 A 3/1971 Dickson
3,744,199 A 7/1973 Navarre
3,839,839 A * 10/1974 Tillisch et al. ..... 52/846
3,935,681 A 2/1976 Voiturier et al.
3,955,330 A 5/1976 Wendt
3,964,214 A 6/1976 Wendt
(Continued)

FOREIGN PATENT DOCUMENTS

CA 2234347 10/1999
(Continued)

OTHER PUBLICATIONS

International Search Report for Application No. PCT/US2008/073920, dated Apr. 9, 2009.
(Continued)

*Primary Examiner* — William Gilbert
*Assistant Examiner* — Theodore Adamos
(74) *Attorney, Agent, or Firm* — Knobbe, Martens, Olson & Bear, LLP

(57) ABSTRACT

Slotted header tracks for exterior wall applications. In exterior wall framing, the exterior wall sheathing is required to have a horizontal gap at or near the floor line for anticipated vertical movement between the floors. To accommodate orthogonal movement of the studs relative to the track, a plurality of slots are located along the flanges of the header track. An area for exterior sheathing attachment is created by leaving the upper portion of the flange solid for sheathing attachment and providing slots on the lower portion of the flange. Embodiments may include elongate reinforcing grooves on the slotted track's flanges and/or web, tabs for supporting and positioning exterior sheathing elements, connector elements for connecting the track to another surface, and second slots along the length of the web of the track to allow for limited drift movement of the track.

15 Claims, 4 Drawing Sheets

U.S. PATENT DOCUMENTS 4,011,704 A * 3/1977 O'Konski ..... 52/481.1
4,103,463 A 8/1978 Dixon
4,130,972 A 12/1978 Varlonga
4,144,335 A 3/1979 Edwards
4,152,878 A * 5/1979 Balinski ..... 52/481.1
4,164,107 A 8/1979 Kraemling et al.
4,283,892 A 8/1981 Brown
4,318,253 A 3/1982 Wedel
4,329,820 A 5/1982 Wendt
4,437,274 A 3/1984 Slocum et al.
4,649,089 A 3/1987 Thwaites
4,672,785 A 6/1987 Salvo
4,709,517 A 12/1987 Mitchell et al.
4,723,385 A 2/1988 Kallstrom
4,787,767 A 11/1988 Wendt
4,825,610 A 5/1989 Gasteiger
4,850,385 A 7/1989 Harbeke
4,885,884 A * 12/1989 Schilger ..... 52/354
5,010,702 A 4/1991 Daw et al.
5,103,589 A 4/1992 Crawford
5,125,203 A 6/1992 Daw
5,127,203 A 7/1992 Paquette
5,127,760 A * 7/1992 Brady ..... 403/230
5,146,723 A 9/1992 Greenwood et al.
5,155,957 A 10/1992 Robertson et al.
5,157,883 A * 10/1992 Meyer ..... 52/357
5,222,335 A 6/1993 Petrecca
5,244,709 A 9/1993 Vanderstukken
5,285,615 A * 2/1994 Gilmour ..... 52/846
5,325,651 A * 7/1994 Meyer et al. ..... 52/715
5,367,850 A 11/1994 Nicholas
5,374,036 A 12/1994 Rogers et al.
5,390,465 A 2/1995 Rajecki
5,394,665 A 3/1995 Johnson
5,412,919 A 5/1995 Pellock et al.
5,452,551 A 9/1995 Charland et al.
5,456,050 A 10/1995 Ward
5,471,805 A 12/1995 Becker
5,592,796 A 1/1997 Landers
5,644,877 A 7/1997 Wood
5,687,538 A * 11/1997 Frobosilo et al. ..... 52/846
5,689,922 A 11/1997 Daudet
5,755,066 A 5/1998 Becker
5,787,651 A 8/1998 Horn et al.
5,797,233 A 8/1998 Hascall
5,806,261 A 9/1998 Huebner et al.
5,913,788 A * 6/1999 Herren ..... 52/241
5,921,041 A 7/1999 Egri, II
5,927,041 A * 7/1999 Sedlmeier et al. ..... 52/836
5,930,963 A 8/1999 Nichols
5,950,385 A * 9/1999 Herren ..... 52/481.1
6,058,668 A 5/2000 Herren
6,151,858 A * 11/2000 Ruiz et al. ..... 52/481.1
6,176,053 B1 1/2001 St. Germain
6,189,277 B1 2/2001 Boscamp
6,213,679 B1 * 4/2001 Frobosilo et al. ..... 403/403
6,216,404 B1 4/2001 Vellrath
6,233,888 B1 5/2001 Wu
6,305,133 B1 10/2001 Cornwall
6,374,558 B1 4/2002 Surowiecki
6,430,881 B1 8/2002 Daudet et al.
6,647,691 B2 11/2003 Becker et al.
6,732,481 B2 5/2004 Stahl, Sr.
6,783,345 B2 8/2004 Morgan et al.
6,799,404 B2 10/2004 Spransy
6,843,035 B1 1/2005 Glynn
6,854,237 B2 2/2005 Surowiecki
6,871,470 B1 3/2005 Stover
7,152,385 B2 12/2006 Morgan et al.
7,191,845 B2 3/2007 Loar
7,240,905 B1 7/2007 Stahl, Sr.
7,302,776 B2 12/2007 Duncan et al.
7,540,118 B2 6/2009 Jensen
7,617,643 B2 11/2009 Pilz et al.
7,681,365 B2 3/2010 Klein
7,775,006 B2 8/2010 Giannos
7,814,718 B2 10/2010 Klein
2002/0170249 A1 11/2002 Yulkowski
2003/0079425 A1 5/2003 Morgan et al.
2003/0213211 A1 11/2003 Morgan et al.
2004/0010998 A1 * 1/2004 Turco ..... 52/762
2004/0045234 A1 3/2004 Morgan et al.
2004/0139684 A1 * 7/2004 Menendez ..... 52/720.1
2004/0211150 A1 10/2004 Bobenhausen
2005/0246973 A1 11/2005 Jensen
2006/0032163 A1 2/2006 Korn
2006/0123723 A1 6/2006 Weir et al.
2006/0137293 A1 6/2006 Klein
2007/0068101 A1 3/2007 Weir et al.
2007/0261343 A1 11/2007 Stahl, Sr.
2008/0087366 A1 4/2008 Yu et al.
2008/0134589 A1 6/2008 Abrams et al.
2008/0172967 A1 7/2008 Hilburn
2008/0250738 A1 * 10/2008 Howchin ..... 52/235
2009/0038764 A1 2/2009 Pilz
2009/0049777 A1 2/2009 Pilz et al.
2009/0049781 A1 2/2009 Pilz et al.
2009/0090074 A1 4/2009 Klein
2009/0094912 A1 4/2009 Klein
2009/0178369 A1 7/2009 Pilz et al.
2010/0126092 A1 5/2010 Pilz et al.

FOREIGN PATENT DOCUMENTS

EP 0346126 12/1989
GB 2159051 11/1985
GB 2411212 8/2005
JP 06146433 5/1994
JP 06220934 8/1994
WO WO 03/038206 5/2003
WO WO 2007/103331 9/2007

OTHER PUBLICATIONS

Catalog page from Stockton Products, printed from www.stocktonproducts.com, on Dec. 16, 2007, showing #5 Drip, in 1 page.

* cited by examiner

EXTERIOR WALL CONSTRUCTION PRODUCT

RELATED APPLICATIONS

This application claims benefit under 35 U.S.C. §119(e) to U.S. Provisional Patent Application No. 61/021,418, filed on Jan. 16, 2008. Also incorporated herein in their entireties by reference are U.S. application Ser. No. 12/013,361 entitled Fire Rated Wall Construction Product, filed Jan. 11, 2008, and U.S. application Ser. No. 12/040,658, entitled Two-Piece Track System, filed Feb. 29, 2008.

BACKGROUND OF THE INVENTION

1. Field of the Invention

This application is directed toward a slotted track device for use in building construction, particularly for use in the exterior wall of a building.

2. Description of the Related Art

Slotted tracks are commonly used in the construction industry, including in the exterior walls of buildings. They generally resemble a U-shaped (or some other similarly shaped) elongated tube capable of receiving or covering the ends of wall studs and holding the wall studs in place.

The slotted tracks generally have a web and at least one flange. Along the flanges of the slotted tracks generally are a plurality of slots. When the wall studs are placed into a slotted track, the plurality of slots permit attachment of the wall studs to the slotted track. The slots allow the wall studs to move generally orthogonally relative to the track. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move.

Also along the flanges of the slotted tracks generally are areas for attachment of exterior sheathing elements. However, in many current slotted tracks, the slots take up the majority of the flanges of the track, leaving little room for attachment of exterior sheathing elements. For example, angle-shaped sheet metal tracks are commonly used on the outsides of wall studs. Each of these angle-shaped sheet metal tracks has a top web portion and one extending flange portion. The extending flange portion normally has a plurality of slots, but the slots extend nearly to the intersection of the flange and web. Because of this, there is little room for attachment of exterior sheathing elements to the flange of the slotted track.

It is also often difficult to locate the proper location for attachment of an exterior sheathing element along the flange of a slotted track. If the sheathing elements are misaligned and overlap a portion of the plurality of slots, the generally orthogonal movement of the studs can be limited.

SUMMARY OF THE INVENTION

This application is directed toward an improved slotted track device and system capable of use in building construction. Its primary use is in the exterior wall of a building. The device includes a plurality of slots located along at least one flange of the slotted track. The slots permit attachment of the slotted track to a wall stud or studs. The slots also allow for generally orthogonal movement of the wall studs relative to the slotted track during an earthquake or some other event where movement of the studs is desired.

In at least one embodiment, the device includes at least one elongate reinforcing groove along at least one portion of the track to provide added stability to the slotted track. The groove can protrude outwardly or inwardly from the slotted track.

In one embodiment, an outward groove along the flange of the track has a secondary function in providing a ridge against which an exterior sheathing element can rest. This ridge helps to ensure proper alignment or placement of the exterior sheathing element during attachment of the sheathing element to the slotted track.

It is also contemplated that in at least one embodiment the present inventive slotted track comprises a plurality of tabs. The tabs are located along a flange of the slotted track and provide resting points for the exterior sheathing elements during attachment of the sheathing elements to the slotted track.

In at least one embodiment the slotted track also comprises a plurality of second slots laterally positioned along the web of the track which permit attachment of the slotted track to a floor or other wall element. The plurality of second slots can be of various shapes, and can allow for drift movement of the track in various directions. For example, in one embodiment the second slots have a generally cross-like pattern, allowing for drift movement in multiple directions.

A system is also contemplated which incorporates a slotted track and connection element. In at least one embodiment, the connection element acts as a washer, and includes a rubber or other compressible material layer which presses against the underside of the web. The connection element has a hole or holes through which a nail or other fastening element is placed. The connection element can also have a geometrical profile substantially similar to that of at least a portion of the web.

BRIEF DESCRIPTION OF THE DRAWINGS

These and other features, aspects and advantages of the various devices, systems and methods presented herein are described with reference to drawings of certain embodiments, which are intended to illustrate, but not to limit, such devices, systems, and methods. The drawings include 7 figures. It is to be understood that the attached drawings are for the purpose of illustrating concepts of the embodiments discussed herein and may not be to scale.

DETAILED DESCRIPTION OF THE PREFERRED EMBODIMENT

Figure 1:
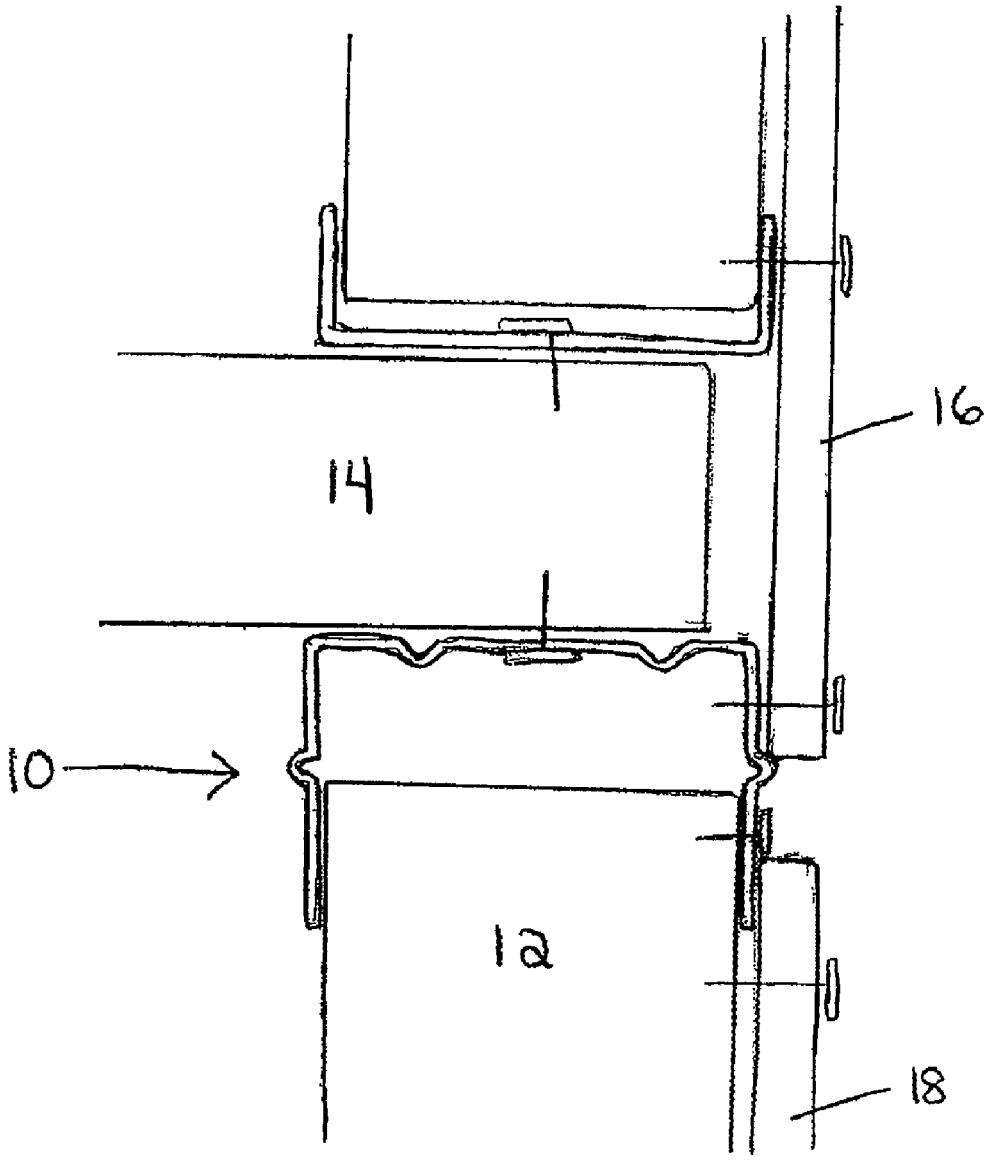
FIG. 1 illustrates a cross-sectional view of the exterior portion of a building, including a slotted track, a floor slab, a wall stud, and two pieces of exterior sheathing.

Referring to FIG. 1, the inventive slotted track 10 can be used with a wall stud 12, a floor slab 14, and two pieces of exterior sheathing elements 16 and 18. In use, the slotted track 10 is connected to the bottom surface of floor slab 14 by an acceptable fastening means. The two exterior sheathing elements 16 and 18 are positioned and attached alongside the exterior portion of the slotted track 10 such that sheathing element 16 ends just prior to a plurality of slots (not shown) along a portion of one flange of slotted track 10.

Figure 2:
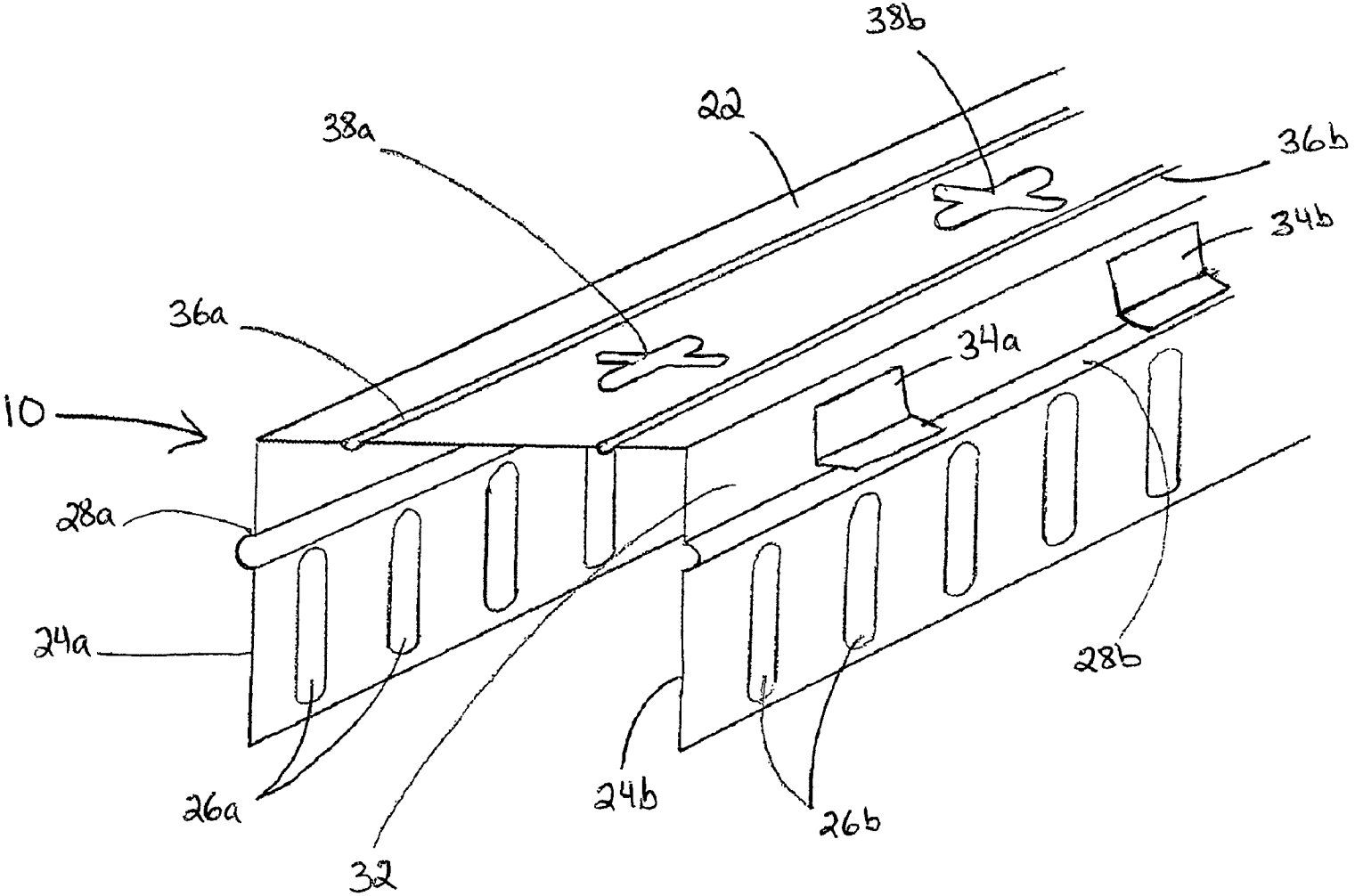
FIG. 2 illustrates a perspective view of an embodiment of the slotted track of FIG. 1, further comprising a plurality of tabs.

Referring to FIG. 2, an embodiment of the slotted track 10 comprises a web 22, two flanges 24*a* and 24*b*, and a plurality of slots 26*a* and 26*b* along each of the flanges 24*a* and 24*b*. These slots 26*a* and 26*b* permit attachment of the slotted track 10 to the wall stud 12. The slots 26*a* and 26*b* also generally allow for orthogonal movement of the wall stud 12 relative to the slotted track 10. As discussed above, in those areas of the world where earthquakes are common, movement of the wall studs is important. If the wall studs are rigidly attached to the slotted track and not allowed to move freely in at least one direction, the stability of the wall and the building might be compromised. Thus, with the plurality of slots 26*a* and 26*b* provided in the present slotted track 10, the wall stud 12 is free to move.

In one embodiment, elongate reinforcing grooves 28*a* and 28*b* may be provided along flanges 24*a* and 24*b*. The grooves 28*a* and 28*b* protrude outwards, and provide added stability to the slotted track 10. In other embodiments, one or both grooves can protrude inwardly. In the embodiment of FIG. 2, two grooves 28*a* and 28*b* are used. However, more than two or less than two grooves can also be used. Additionally, a sheathing attachment area 32 is located adjacent the groove 28*b*. The sheathing attachment area 32 is large enough to attach sheathing elements as well as provide added stability to the slotted track 10.

During installation, the sheathing element 16 can be placed against the sheathing attachment area 32 such that the sheathing element's lower portion rests on top of the groove 28*b*. The groove 28*b* thus helps to align the sheathing element 16 so that sheathing element 16 does not cover a portion of the plurality of slots 26*b* and prevent the generally orthogonal movement of the wall stud 12.

Still referring to FIG. 2, the slotted track 10 may further (or alternatively) comprise tabs 34*a* and 34*b*. The tabs 34*a* and 34*b* can be made integral with the slotted track 10 or separately applied to the slotted track 10 either mechanically or by other means. In at least one embodiment, the tabs 34*a* and 34*b* can be fold-down tabs. The tabs 34*a* and 34*b* can lock in place once they have folded down to a certain point or angle. For example, the tabs can have hinges (not shown) which only allow the tab to fold down 90 degrees. In yet other embodiments, the tabs 34*a* and 34*b* can include a lip or groove (not shown) for holding the sheathing element 16 in place while it is being attached. During installation of the sheathing elements, the tabs help to align the sheathing element 16 so that sheathing element 16 does not cover a portion of the plurality of slots 26*b* and prevent the generally orthogonal movement of the wall stud 12. While the present embodiment includes two tabs, additional embodiments can include other numbers of tabs. Furthermore, in at least one embodiment, the tabs can be spaced evenly along the sheathing attachment area 32 of slotted track 10.

The slotted track 10 may further comprise elongate reinforcing grooves 36*a* and 36*b* along the web 22. Grooves 36*a* and 36*b* provide added stability to the slotted track 10. Positioned between grooves 36*a* and 36*b*, and laterally positioned along the web 22 of slotted track 10, are second slots 38*a* and 38*b*. The second slots can be of various shapes, including but not limited to that of a cross slot. In at least one embodiment, the second slots 38*a* and 38*b* allow for limited drift and seismic movement of the track 10. While the present embodiment includes two second slots, additional embodiments can include other numbers of second slots.

Figure 3:
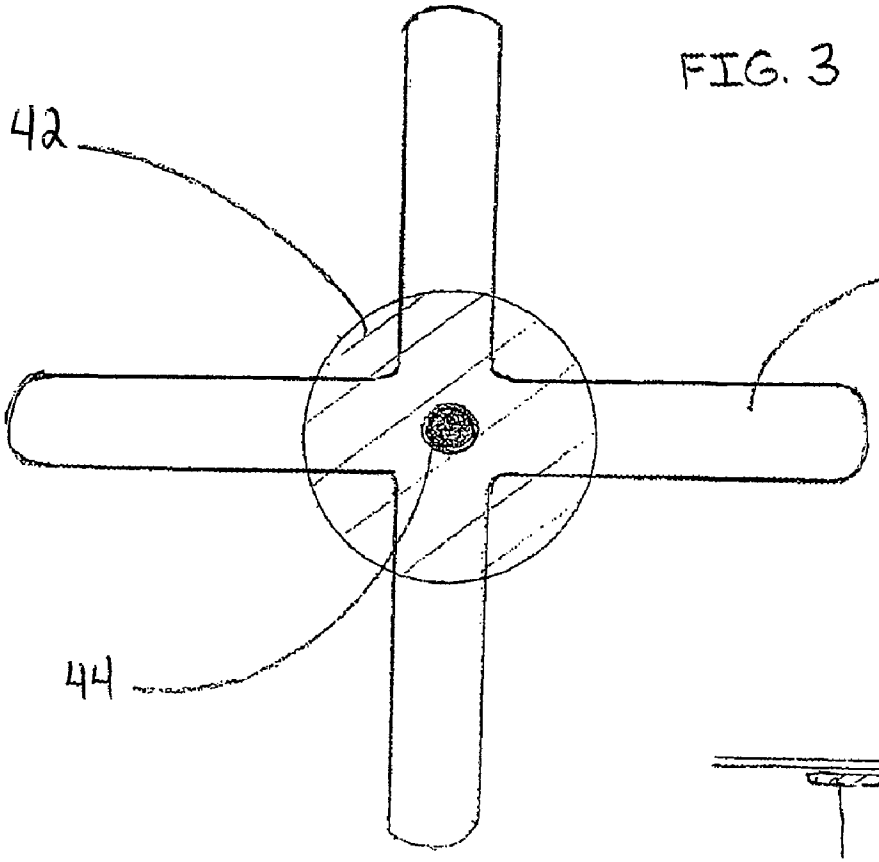
FIG. 3 illustrates a bottom plan view of a second slot located along the web of the slotted track of FIG. 2.
Figure 4:
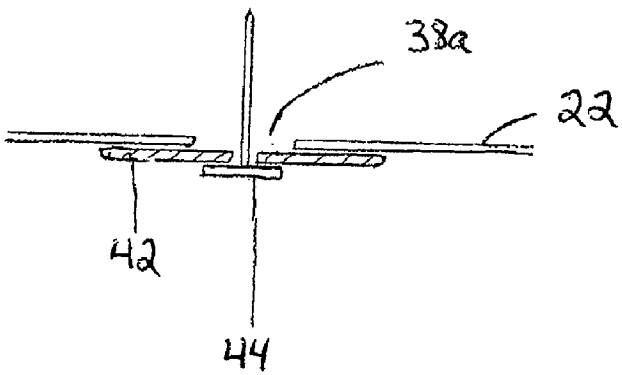
FIG. 4 illustrates a cross sectional view of the second slot of FIG. 3.

Referring to FIGS. 3 and 4, the second slot 38*a* can be used with a washer 42 and fastener 44. The fastener 44 contacts the washer 42, which is positioned between the head of the fastener and the web 22 of slotted track 10, and fastens the slotted track 10 to the floor slab 14. Once fastened, the second slot 38*a* allows for drift and seismic movement of the slotted track 10 in multiple directions.

Figure 5:
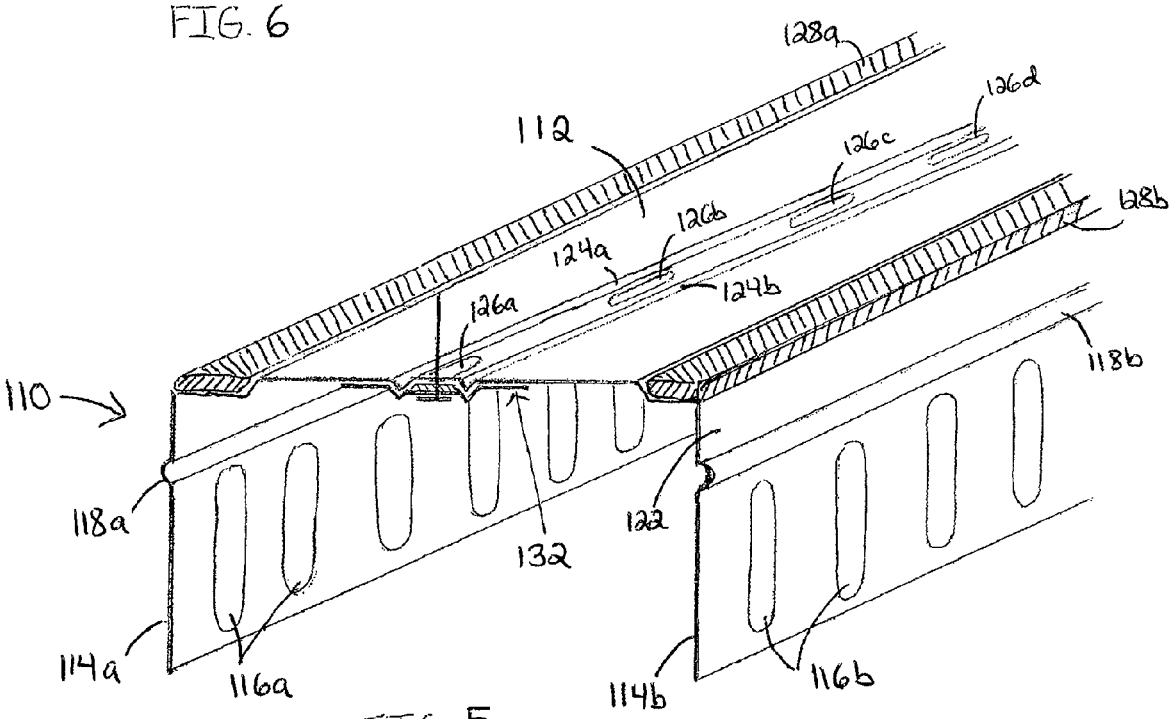
FIG. 5 illustrates a perspective view of an embodiment of a slotted track system, including a connection element.

Referring to FIG. 5, an embodiment of a slotted track system incorporates a slotted track 110. The slotted track 110 comprises a web 112, two flanges 114*a* and 114*b*, a plurality of slots 116*a* and 116*b*, grooves 118*a* and 118*b* along the flanges, a sheathing attachment area 122, grooves 124*a* and 124*b* along the web, and second slots 126*a-d* located along the web. The slotted track 110 additionally comprises strips of intumescent material 128*a* and 128*b* attached to at least a portion of the web 112. In use, the intumescent material expands rapidly when heated, thus sealing off areas around the slotted track 110 and helping to prevent fire, smoke, or other debris from moving past or around the slotted track 110.

Figure 6:
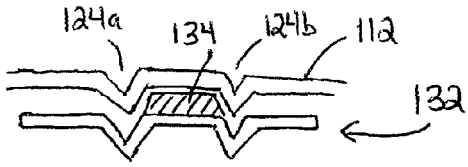
FIG. 6 illustrates a cross sectional view of the connection element of FIG. 5.
Figure 7:
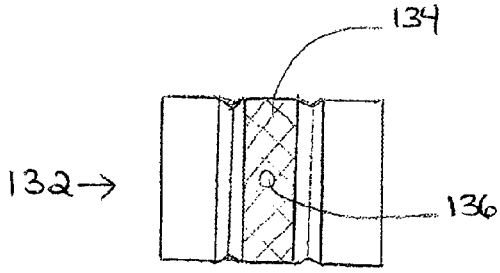
FIG. 7 illustrates a top plan view of the connection element of FIG. 5.

The slotted track system additionally incorporates a connection element 132. The connection element 132 can be applicable to both interior and exterior walls. In at least one embodiment, the connection element 132 can have a substantially W-shape. Referring to FIG. 6, the connection element 132 has a geometrical profile substantially similar to that of at least a portion of the web 112. This allows the connection element 132 to remain close to or contact the web 112 once attached. A strip of compressive material 134, such as for example rubber, is attached to the connection element 132. The compressive material 134 is configured to be positioned between the connection element 132 and the web 112. Referring to FIGS. 5 and 7, a fastener extends through a hole 136 in the compressive material 134 and connection element 132 and through one of the second slots in the web 112 to secure the track 110 to a floor slab. The compressive material 134 compresses under pressure when the connection element 132 is attached to the slotted track 110 and acts as a gasket. The compressive material 134 additionally allows the slotted track 110 to have limited drift movement along the second slots of slotted track 110.

What is claimed is:

1. A header track for an exterior wall comprising:

a web;

two flanges extending from opposite sides of the web, the web and two flanges forming a periphery of the header track such that the header track forms an overall generally C-shaped structure having empty space defined between the two flanges, the generally C-shaped structure being sized and shaped to receive studs for exterior walls;

wherein at least one of the flanges comprises:

a lower portion comprising a plurality of elongate, linear slots, each extending perpendicular to a longitudinal direction of the header track and spaced along a length of the at least one flange for allowing a fastener to pass therethrough and for permitting orthogonal movement of the studs relative to the track, wherein the lower portion is a planar wall extending from a lowermost edge of the at least one flange to a location above uppermost ends of the slots;

at least one elongate groove extending longitudinally along the at least one flange above the plurality of slots, the elongate groove being spacially offset from a plane containing the web and protruding outwardly and away from the empty space defined between the two flanges;

a generally planar solid wall portion for attachment of a sheathing element, the solid wall portion extending downwardly from an edge of the web and longitudinally along the at least one flange directly above the elongate groove; and a plurality of tabs positioned along and attached to the at least one flange beneath the sheathing attachment area, the tabs configured to support the sheathing element, whereby the elongate groove is located between the lower portion and the plurality of tabs.

2. The header track of claim 1, further comprising at least one second slot along the web, the second slot configured to permit attachment of the header track to a wall support and configured to provide for limited drift movement of the header track.

3. The header track of claim 2 comprising a plurality of second slots, wherein the second slots are longitudinally positioned along the web.

4. The header track of claim 2, wherein the at least one second slot comprises a cross-slot.

5. A header track comprising:

a web;

two flanges extending from opposite sides of the web, the web and two flanges forming a periphery of the header track such that the header track forms an overall generally C-shaped structure having empty space defined between the two flanges, the generally C-shaped structure being sized and shaped to receive studs for exterior walls;

wherein at least one of the flanges comprises:

a plurality of elongate, linear slots extending perpendicular to a longitudinal direction of the header track and spaced along a length of the at least one flange for allowing a fastener to pass therethrough and for permitting orthogonal movement of the studs relative to the header track;

a solid wall portion extending downwardly from an edge of the web and longitudinally along the at least one flange for attachment of a sheathing element, the solid wall portion located toward the web relative to the plurality of slots;

a plurality of tabs positioned along and attached to the at least one flange directly beneath the sheathing attachment area, the tabs extending outwardly from the at least one flange substantially perpendicular to an outer surface of the at least one flange a distance sufficient to locate a lowermost edge of the sheathing element relative to the header track, the tabs being spacially offset from a plane containing the web; and an elongate groove extending longitudinally along the at least one flange above the slots and below the plurality of tabs.

6. The header track of claim 5, wherein the tabs are fold-down tabs having a side integrally formed with the at least one flange, and the remaining sides unattached to the at least one flange such that the tabs can fold outwardly relative to the at least one flange.

7. The header track of claim 5, further comprising at least one elongate reinforcing groove along at least one portion of the header track.

8. The header track of claim 5, further comprising at least one second slot along the web, the second slot configured to permit attachment of the header track to a wall support and configured to provide for limited drift movement of the header track.

9. The header track of claim 8 comprising a plurality of second slots, wherein the second slots are laterally positioned along the web.

10. The header track of claim 8, wherein the second slot comprises a cross-slot.

11. An elongate header track comprising:

a web;

two flanges extending from opposite sides of the web, the web and two flanges forming a periphery of the header track such that the header track forms an overall generally C-shaped structure having empty space defined between the two flanges, the generally C-shaped structure being sized and shaped to receive studs for exterior walls;

wherein at least one of the flanges comprises:

a plurality of elongate, linear slots extending perpendicular to a longitudinal direction of the header track and spaced along a length of the at least one flange for allowing a fastener to pass therethrough and for permitting orthogonal movement of the studs relative to the header track;

a solid wall portion extending downwardly from an edge of the web and longitudinally along the at least one flange for attachment of a sheathing element, the solid wall portion located toward the web relative to the plurality of slots; and an elongate groove and at least one tab positioned between the solid wall portion and plurality of linear slots, the elongate groove and the at least one tab extending away from the empty space defined by the two flanges, whereby the groove is located below the at least one tab;

wherein the web comprises a plurality of second slots positioned along the length of the web, the second slots configured to permit attachment of the track to a floor located above the header track and configured to provide for limited drift movement of the header track relative to the floor; and wherein the header track further comprises a connection element configured to be attached to the web adjacent the second slots, the connection element comprising at least one opening for insertion of a fastener through the connection element and a corresponding one of the plurality of second slots.

12. The header track of claim 11, further comprising a strip of compressible material configured to be positioned between the connector element and the web.

13. The header track of claim 11, further comprising a plurality of elongate reinforcing grooves along at least one portion of the header track.

14. The header track of claim 13, wherein the grooves are positioned in the web proximal the second slots, and wherein the connection element is configured to have a geometrical profile substantially similar to that of the web.

15. The header track of claim 11, wherein the connection element comprises a substantial W-shape.

* * * * *

UNITED STATES PATENT AND TRADEMARK OFFICE

CERTIFICATE OF CORRECTION

PATENT NO. : 8,281,552 B2
APPLICATION NO. : 12/039685
DATED : October 9, 2012
INVENTOR(S) : Pilz et al.

It is certified that error appears in the above-identified patent and that said Letters Patent is hereby corrected as shown below:

In the Claims:

In column 4 at line 57, In Claim 1, change "slots, each" to --slots--.

Signed and Sealed this
Thirteenth Day of August, 2013

Teresa Stanek Rea
*Acting Director of the United States Patent and Trademark Office*